US007930980B2

(12) United States Patent
Brooke

(10) Patent No.: US 7,930,980 B2
(45) **Date of Patent: *Apr. 26, 2011**

(54) AUTOMATICALLY STABILIZING TABLE ARRANGEMENT

(75) Inventor: Rory Brooke, Gauteng Province (ZA)

(73) Assignee: Hedera AB, Lund (SE)

( * ) Notice: Subject to any disclaimer, the term of this patent is extended or adjusted under 35 U.S.C. 154(b) by 388 days.

This patent is subject to a terminal disclaimer.

(21) Appl. No.: 11/659,042

(22) PCT Filed: Aug. 2, 2004

(86) PCT No.: PCT/IB2004/002453

§ 371 (c)(1),
(2), (4) Date: Dec. 4, 2008

(87) PCT Pub. No.: WO2006/016199

PCT Pub. Date: Feb. 16, 2006

(65) Prior Publication Data

US 2009/0183653 A1 Jul. 23, 2009

(51) Int. Cl.
*A47B 13/00* (2006.01)

(52) U.S. Cl. ..... 108/153.1; 248/582; 248/188.2; 248/188.7; 108/2

(58) Field of Classification Search ..... 108/153.1, 108/156, 158, 158.13, 1, 2; 248/188.7, 165, 248/188, 188.1, 188.4, 188.8, 188.2, 188.3, 248/431, 592, 582; 297/264.1, 259.1, 259.4, 297/270.1, 258.1

See application file for complete search history.

(56) References Cited

U.S. PATENT DOCUMENTS

| | | | | |
|---|---|---|---|---|
| 2,981,578 | A * | 4/1961 | Saarinen | 108/150 |
| 3,236,485 | A * | 2/1966 | Staples | 108/150 |
| 4,178,858 | A * | 12/1979 | Ponzellini | 108/150 |
| 4,406,437 | A * | 9/1983 | Wright | 248/188.7 |
| 4,712,758 | A | 12/1987 | Cuschera | |
| 4,789,122 | A * | 12/1988 | Gutgsell | 108/150 |
| 4,798,359 | A | 1/1989 | Ball | |
| 5,121,891 | A * | 6/1992 | Goldsmith | 108/150 |
| 5,402,973 | A * | 4/1995 | Haines | 248/188.7 |
| 5,690,303 | A * | 11/1997 | Winters | 248/188.7 |
| 6,019,154 | A * | 2/2000 | Ma et al. | 248/188.3 |
| 7,677,524 | B2 * | 3/2010 | Brooke | 248/188.3 |
| 2008/0087777 | A1 * | 4/2008 | Christian et al. | 248/188.8 |

FOREIGN PATENT DOCUMENTS

| | | |
|---|---|---|
| DE | 92 02 759 | 4/1992 |

OTHER PUBLICATIONS

English translation of DE 9202759 dated April 16, 1992.

* cited by examiner

*Primary Examiner* — José V Chen
(74) *Attorney, Agent, or Firm* — Ladas & Parry LLP

(57) ABSTRACT

An automatically stabilizing table has an elongate support structure (14) supporting a table top (12) at an upper end and having a first pair of feet (50) at a lower end. An elongate guide formation (38) projects from a lower end of the support structure. A displaceable support member (30), having a second pair of feet (32), is engaged with the guide formation such that the displaceable support member is slidably displaceable along the guide formation and is automatically frictionally engageable with the guide formation in response to pivoting of the displaceable support member about a pivot axis which is transverse to the guide formation, to anchor the displaceable support member frictionally against sliding displacement relative to the guide formation. A pair of springs (48) is provided to urge the support member downwardly. The support member is located in channel shaped spokes (20) to inhibit swiveling thereof on the guide formation. The guide formation is preferably a pin received in a bushed guiding passage (36) in the support member.

17 Claims, 4 Drawing Sheets

AUTOMATICALLY STABILIZING TABLE ARRANGEMENT

THIS INVENTION relates to tables. In particular, the invention relates to a table support arrangement, to a table stabilizing arrangement, and to a table.

The invention provides a table support arrangement which includes:

an elongated table support structure for connection at an operatively upper end thereof to a table top, the table support structure having a first pair of feet at or adjacent an operatively lower end of the support structure;

an elongated guide formation fast with the table support structure, the guide formation projecting from an operatively lower end of the support structure; and a displaceable support member which has a second pair of feet at or adjacent an operatively lower end thereof, such that a line drawn between the feet of the first pair is transverse to a line drawn between the feet of the second pair, the displaceable support member being engaged with the guide formation such that the displaceable support member is slidably displaceable along a rectilinear guided path which is transverse to the lines respectively drawn between both said pairs of feet, the engagement of the displaceable support member with the guide formation being such that the displaceable support member is automatically frictionally engageable with the guide formation in response to pivoting of the displaceable support member about a pivot axis which is transverse to the displaceable support member=s guided path, to anchor the displaceable support member frictionally against sliding displacement relative to the guide formation.

It will be appreciated that the displaceable support member will thus be slidably displaceable along its guided path when there is substantially no nett moment on the displaceable support member about any pivot axis which is transverse to the guided path and which intersects the guide formation, to displace the second pair of feet linearly relative to the first pair of feet, while linear displacement of the displaceable support member along its guided path is limited by automatic frictional engagement of the displaceable support member with the guide formation in response to the application to the displaceable support member of a nett moment about any such pivot axis.

Typically, the guide formation is an elongated guide pin which projects operatively downwardly from the table support structure, the feet of the second pair being equally radially spaced from the guide pin, so that the displaceable support member is linearly slidably displaceable along the guide pin when equal forces in the lengthwise direction of the guide pin are applied to the feet of the second pair.

Preferably, the table support arrangement has only four feet, the feet of each said pair of feet being diametrically opposed to each other about the guide pin and the feet being equally circumferentially spaced about the guide pin, so that lines drawn between the respective feet of the pairs intersect at the guide pin and are perpendicular to each other.

The table support structure may comprise an elongated operatively upright post and a spider connected to an operatively lower end of the post, the spider comprising four radially extending spokes which are spaced apart 90° in a circumferentially extending series, each spoke being broadly channel-shaped and opening operatively downwardly, the displaceable support member being in the form of an arm which is received in a pair of aligned spokes, extending lengthwise along said pair of aligned spokes.

The displaceable arm may have a guiding passage therethrough, the guiding passage being complementary in shape and in dimensions to the guide pin, so that the guide pin is received in the guiding passage with an annular working gap.

In one embodiment of the invention, the guiding passage is lined by a cylindrical bush, the guide pin being a sliding frictional fit in the bush. Instead, the displaceable arm may include a pair of axially spaced apart cylindrical bushes lining a part of a cylindrical wall of the guiding passage.

The support structure may include at least one urging member for urging the displaceable support member away from the support structure. Typically, the urging members are provided by a pair of stressed springs under compression acting between the displaceable support member and the support structure, the springs being equally radially spaced on diametrically opposite sides of the guide formation.

According to a preferred form of the invention, there is provided a self stabilizing arrangement for a table, which includes:

a first support component having at each end a foot projecting in the same direction;

a guide pin fast with the first support component, the guide pin being centrally positioned with respect to the first support component and projecting in the same direction as the feet of the first support component; and a second support component which is slidably mounted on the pin and which also has a foot at each end thereof projecting in the same direction as the feet of the first support component.

Typically, the second support component is centrally mounted on the pin, such that the pin is engaged with a complementary mating guiding passage in the second support component, the guiding passage being centrally located in the second support component.

In a preferred embodiment of the invention, the first support component and the second support component are orthogonal, for instance respectively being elongated and being arranged such that the lengthwise directions of said support members are substantially normal to each other. The stabilizing arrangement may in such case include a locating arrangement for keeping the members in said orthogonal relationship. In one embodiment of the invention, the locating arrangement includes a pair of aligned spokes which respectively extend radially relative to the guide pin, the spokes being fast with the first support component and the spokes together defining a channel extending along the aligned spokes, the second support component being received in said channel such that the spokes inhibit or restrict swiveling movement of the second support component about the guide pin.

The guide pin, on the one hand, and the guiding passage in the second support component, on the other hand, may be shaped and dimensioned such that there is limited clearance between the guide pin and the second support component, so that there is automatic frictional locking of the second support component on the guide pin when a couple, or a nett moment about the guide pin, is exerted on the second support component.

The invention extends to a table which includes a table support arrangement or a self stabilizing arrangement as defined above, and a table top mounted on the table support arrangement or the self stabilizing arrangement.

The invention will now be further described, by way of example, with reference to the accompanying diagrammatic drawings, in which.

Figure 1:
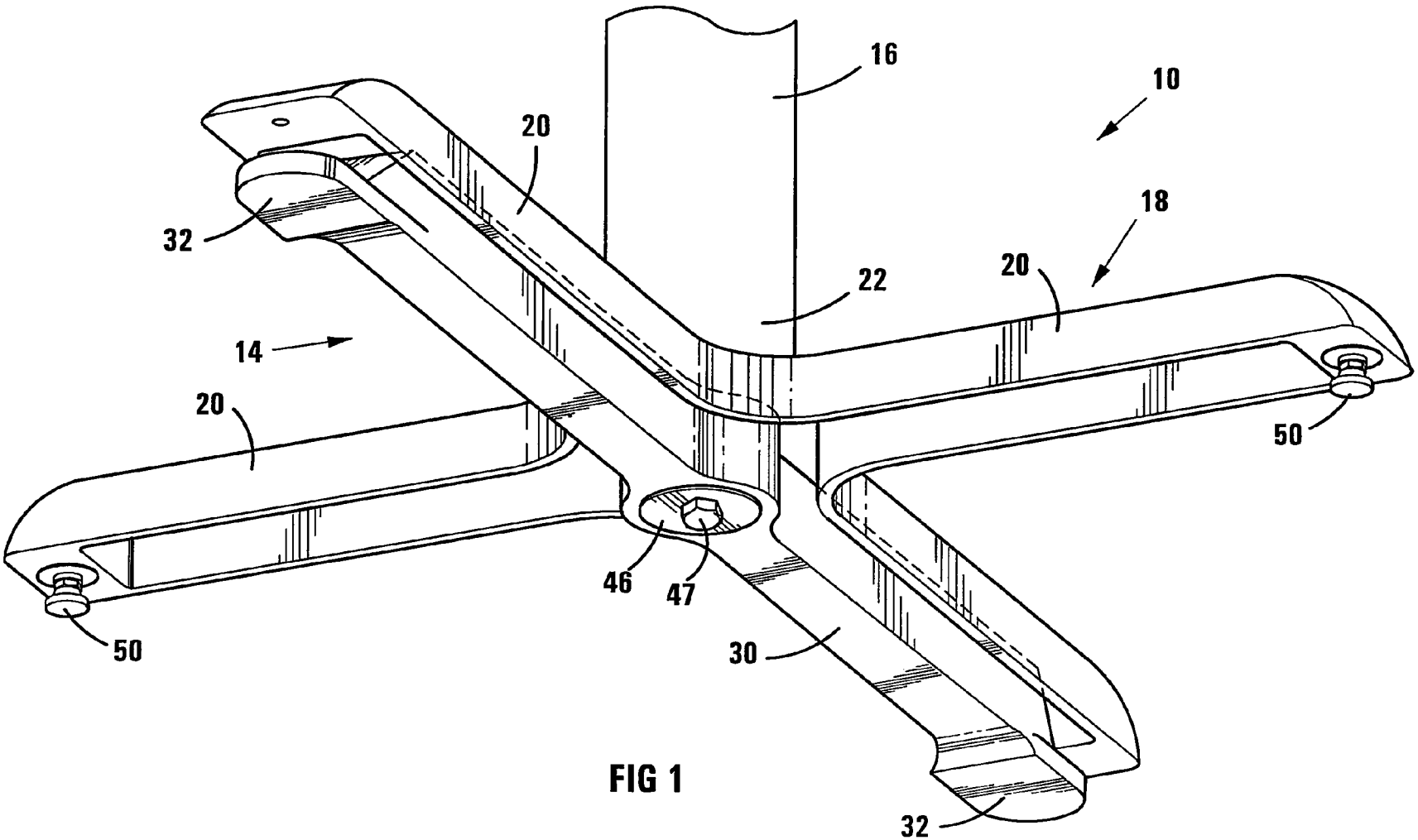
FIG. 1 is a schematic partial three-dimensional view of a table in accordance with the invention.

In FIGS. 1 to 4 of the drawings, reference numeral 10 generally indicates a table in accordance with the invention. The table comprises a table top 12 mounted on a table support structure 14. The table support structure 14 in turn comprises an operatively upright post 16 having a longitudinal axis 17 and a spider 18 which includes four radially extending equally angularly spaced spokes 20 connected to a lower end 22 of the post 16. The spider 18 is shaped such that a plane defined by the bottom ends of the spokes 20 is normal to the lengthwise direction of the post 16.

Figure 2:
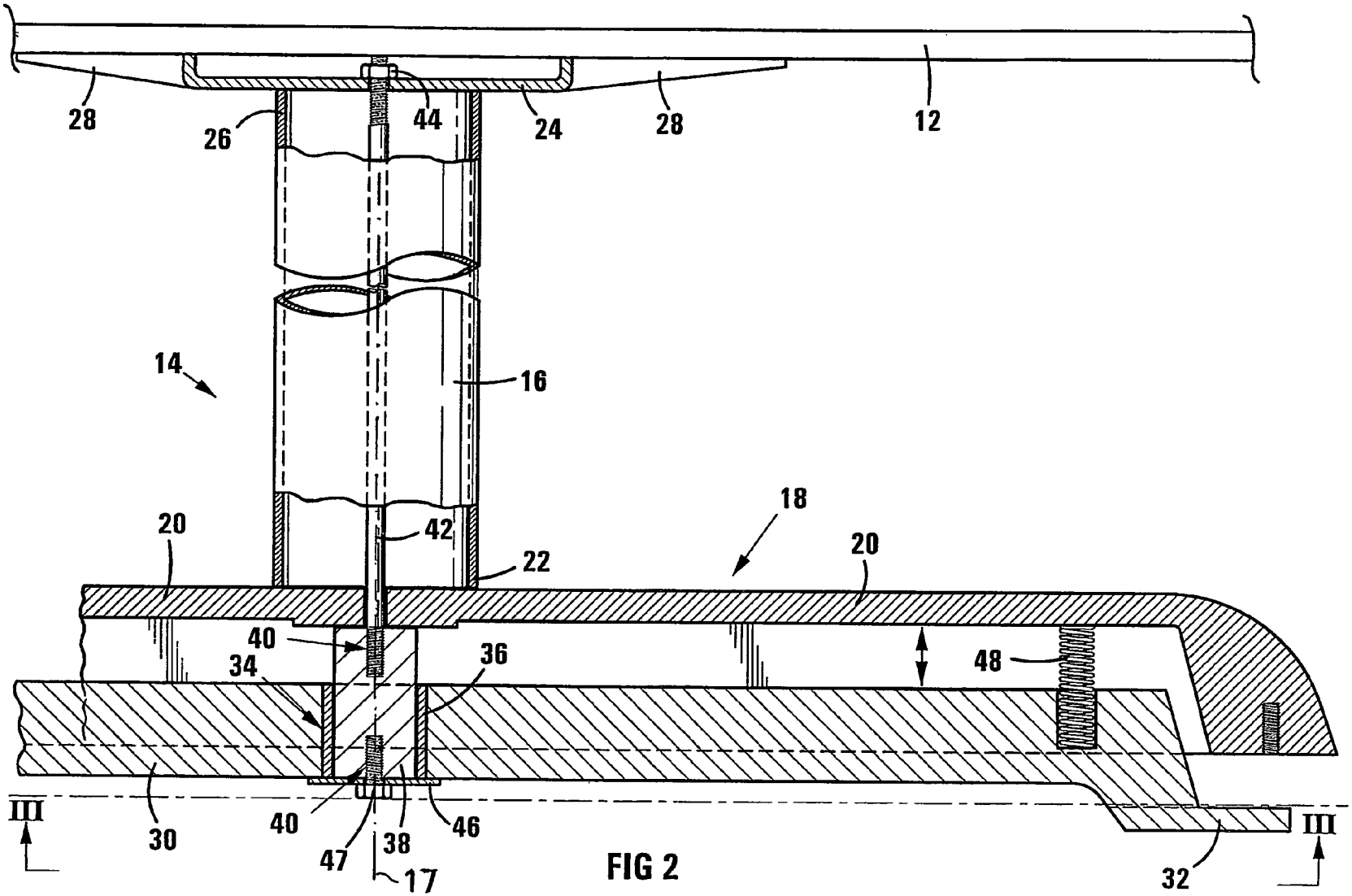
FIG. 2 is a schematic partial sectional side view of the table of FIG. 1.
Figure 3:
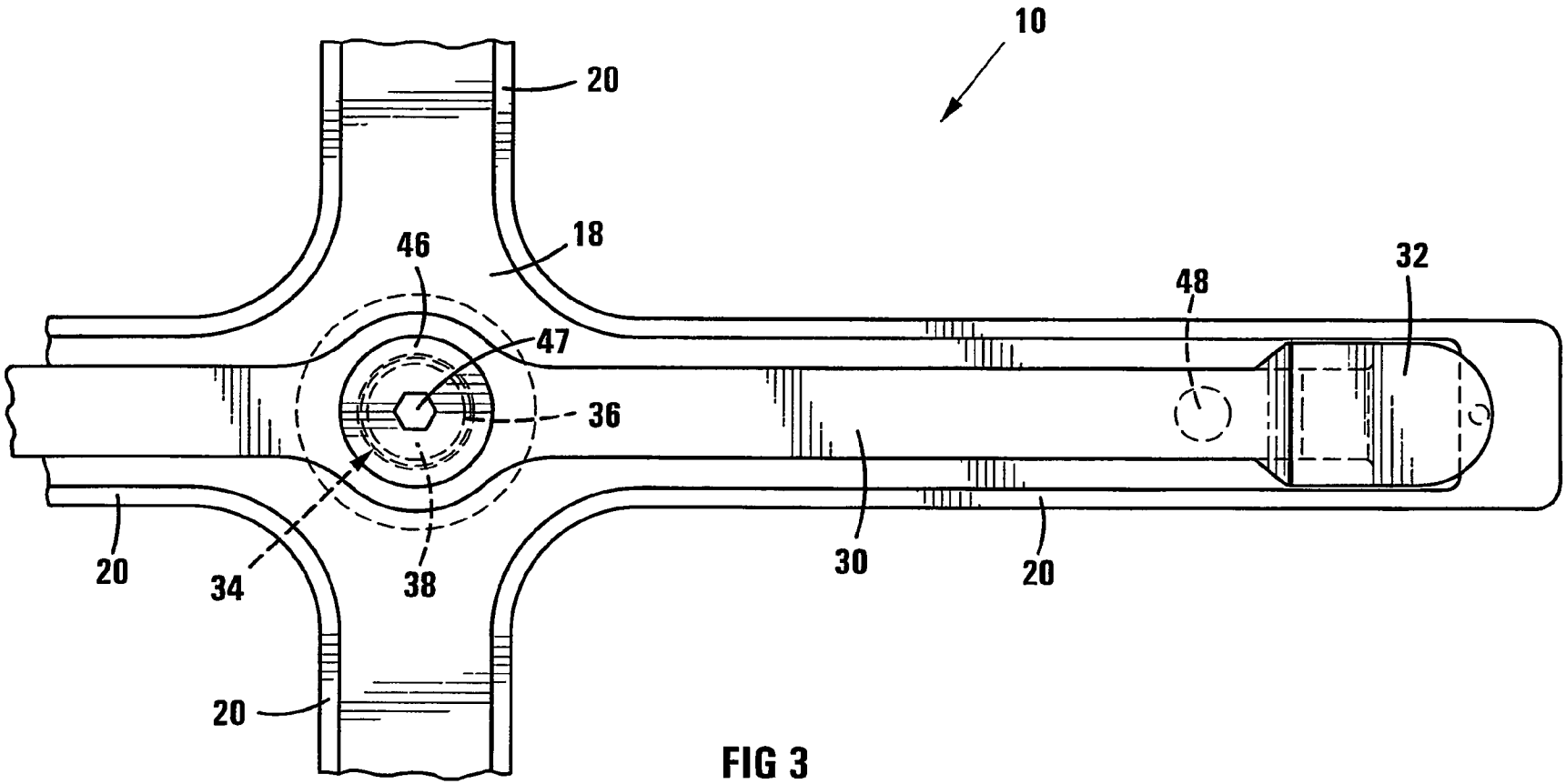
FIG. 3 is a schematic partial bottom plan view of the table of FIG. 1.
Figure 4:
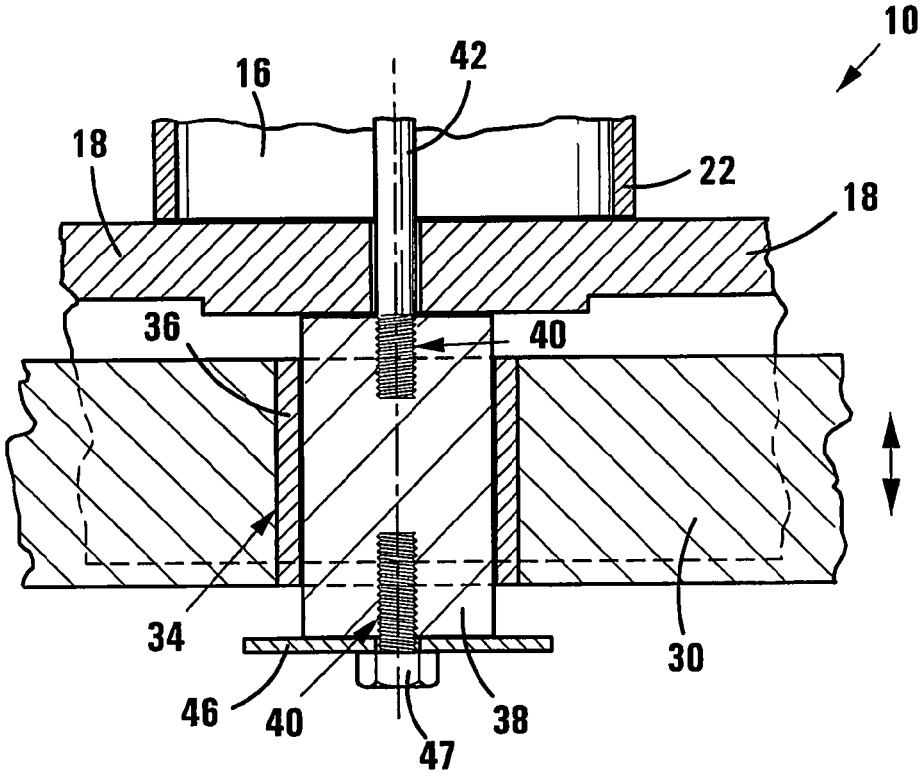
FIG. 4 is, on an enlarged scale, a detailed view of a displacement limiting mechanism forming part of the table of FIG. 1.

A mounting member 24 is connected to the upper end 26 (FIG. 2) of the post 16, the mounting member 24 comprising a series of four angularly spaced mounting flanges 28 (FIG. 2). Each mounting flange 28 has a pair of apertures (not shown) therethrough, through which screws (also not shown) are passed, the screws being screwed into the table top 12, to mount the table top 12 on the table support structure 14.

Each spoke 20 is channel-shaped and opens downwardly, thus having a broadly U-shaped cross-sectional profile. A displaceable support member in the form of an elongated displaceable arm 30 is received in a first pair of aligned spokes 20, extending lengthwise along said pair of spokes 20. The displaceable arm 30 constitutes a second support component having a downwardly projecting foot 32 at each end thereof.

As can be seen in FIG. 1 of the drawings, the spokes 20 of the other, second pair of aligned spokes 20, i.e. the spokes 20 which extend perpendicularly to the arm 30, are each provided with an operatively downwardly projecting knob at its radially outer end, each knob forming a fixed foot 50. The second pair of spokes constitutes a first support component.

The spider 18 forms a locating arrangement for keeping the displaceable arm 30 perpendicular to the other pair of spokes 20 by restricting swivelling displacement of the displaceable arm 30 about the guide pin 38.

The arm 30 has a circular guiding passage 34 extending transversely through it, the passage 34 being lined by a cylindrical bush 36. The arm 30 is of cast iron, while the bush 36 is of machined mild steel. The passage 34 has a longitudinal axis, not shown.

A guide formation in the form of a guide pin 38 projects downwardly from the lower end 22 of the post 16, inside the cavity defined by the spider 18, the guide pin 38 being co-axially aligned with the post 16. The guide pin 38 is slidably received in the passage 34, the guide pin 38 being dimensioned such that it is a sliding frictional fit in the bush 36, there being a small annular working clearance between the bush 36 and the pin 38. The bush 36 and the pin 38 are respectively machined to relatively fine tolerances, in this case being machined to a tolerance of between 5 and 15 μm. It will be appreciated that the arm 30 is thus linearly slidable along the pin 38 as long as the passage 34 is co-axially aligned with the pin 38, but that the bush 36 automatically frictionally engages the pin 38 when the arm 30 is tilted about a pivot axis which is transverse to the guide pin 38, i.e. when the longitudinal axis of the pin 38 and the longitudinal axis of the passage 34 are not parallel.

The pin 38 has a blind screw-threaded bore 40 at each of its ends, the bore 40 closest to the post 16 being screw-threadedly engaged with a tightening rod 42 which extends lengthwise along the hollow interior of the post 16. The tightening rod 42 passes, at its one end, through a complementary opening in the spider 18, and at its other end, through a complementary opening in the mounting member 24, a tightening nut 44 being screw threadedly engaged with the upper end of the rod 44. Thus, the pin 38 doubles as a nut, so that tightening of the pin 38 places the rod 42 under tension, clamping the mounting member 24 to the upper end 26 of the post, and clamping the spider 18 to the lower end 22 of the post 16.

A stop washer 46 is connected to the lower end of the pin 38 by a bolt 47 which is screwed into the screw-threaded bore 40 at the lower end of the pin 38, the washer 46 having a diameter which is greater than the diameter of the passage 34, so that the washer 46 limits sliding displacement of the arm 30 along the pin 38 by abutment of the arm 30 against the washer 46. The passage 34 may be stepped, to be wider at its bottom end, with an internal shoulder against which the washer 46 bears, such that the washer 46 and the head of the bolt 47 are within the passage.

The table 10 includes a pair of coiled springs 48 (only one of which is shown in FIG. 2) under compression, the springs 48 acting between the spider 18 and the arm 30, to urge the arm 30 operatively downwardly away from the spider 18, the springs 48 being under compression even when the arm abuts the stopping washer 46. Although not shown in FIG. 2 of the drawings, the springs 48 are spaced an equal radial distance from the guide pin 38, and are diametrically opposed about the pin 38.

In use, the table support structure 14 supports the table top 12 on a support surface such as the ground (not shown). When the ground surface is uneven, the table support structure 14 is automatically operable to displace the arm 30 relative to the spider 18 such that all four feet 50, 32 bear against the support surface.

When, for instance, the ground is uneven such that both of the fixed feet 50 bear against the ground, but only one of the displaceable feet 32 at a time touches the ground, the displaceable arm 30 is urged downwardly relative to the spider 18 until both of the displaceable feet 32 bear against the ground. It will be appreciated that the displaceable arm 30 is only slidably displaceable along the guide pin 38 when equal forces 32 are exerted on the feet 32. When the feet 32 are exposed to unequal forces, the arm 30 pivots about a pivot axis transverse to the lengthwise direction of the guide pin 38, and the bush 36 automatically frictionally engages the guide pin 38, thus locking the arm 30 on the pin 38, anchoring it against lengthwise sliding displacement along the pin 38.

Thus, in an instance as described above, the table 10 will tend to rock by pivoting of the spider 18 about an axis aligned with a line interconnecting the fixed feet 50. During such rocking, the displaceable arm 30 is urged downwardly by the springs 48 when both feet 32 are clear of the ground, i.e. when no external forces are exerted on the feet 32, the arm 30 being automatically locked in position on the guide pin 38 when either of the feet 32 abut against the ground. The displaceable arm 30 thus automatically finds a position where both its feet 32, as well as the fixed feet 50 bear against the ground.

In instances where the ground is uneven such that both the displaceable feet 32, but only one of the fixed feet 50, bear against the ground, the arm 30 is displaced upwardly along the guide pin 38 until both the fixed feet 50 bear against the ground surface. It will be appreciated that, in order for the arm 30 to be in equilibrium, upward forces exerted by the ground on the displaceable feet 32 must be equal to each other, the feet 32 being equally spaced from the guide pin 38, and these equal upward forces cause upward displacement of the arm 30 against the urging of the springs 48 until the table support structure 14 attains a stable, static condition.

Once all four feet 32, 50 bear against the ground, the table 10 remains stable, as the arm 30, and therefore the feet 32, is effectively locked in position. This is because any attempt at rocking the table 10 will result in the application of unequal forces to the feet 32, causing automatic and immediate frictional locking of the arm 30 on the guide pin 38.

Figure 5:
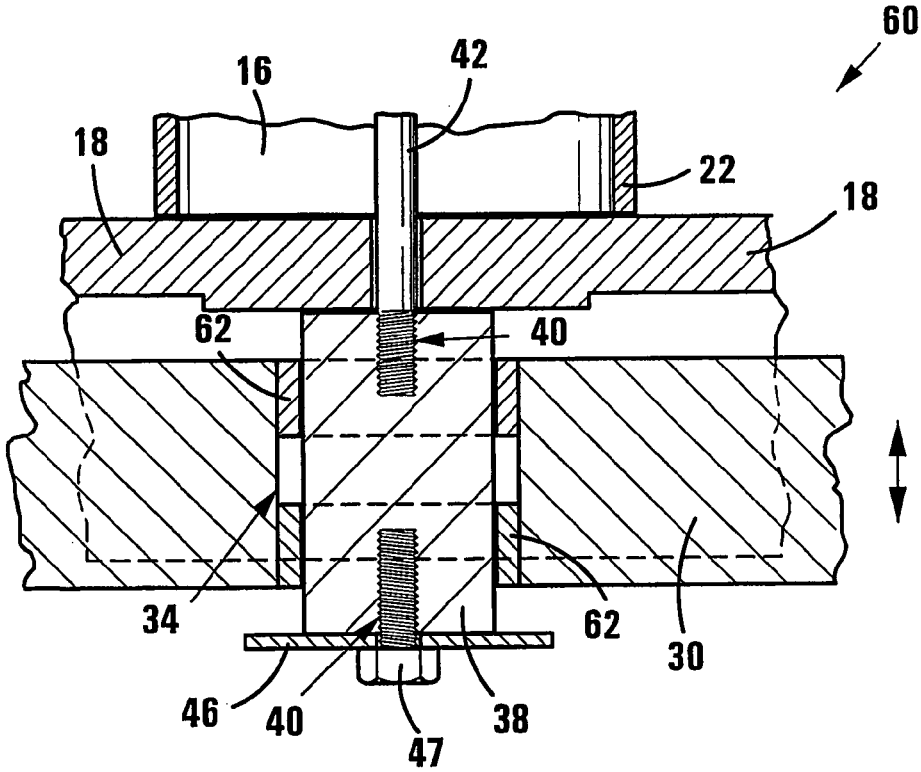
FIG. 5 is a view corresponding to FIG. 4 of a further embodiment of a table in accordance with the invention.

FIG. 5 of the drawings shows a further embodiment of a table in accordance with the invention, with like reference numerals indicating like parts in FIGS. 1 to 4 and FIG. 5. The table 60 of FIG. 5 corresponds substantially to the table 10 of FIGS. 1-4, with the main distinction being that the bush 36 of the table 10 is replaced by a pair of axially spaced cylindrical rings 62.

It is an advantage of the table 10, 60 as described with reference to the drawings that the displaceable arm 30 and the guide pin 38 can be connected to a spider 18 used in the construction of conventional non-stabilizing table supports. This permits the manufacture of a stabilizing table, as described, without the need for large scale alterations to the machinery, such as dies or moulds, used to manufacture conventional tables. Furthermore, the guide pin 38 and displaceable arm 30 can be retrofitted to existing tables, to form a self-stabilising table 10.

The invention claimed is:

1. A table support arrangement comprising:

an elongated table support structure for connection at an operatively upper end thereof to a table top, the table support structure having a first pair of feet at or adjacent an operatively lower end of the support structure;

an elongated guide pin fast with the table support structure, the guide pin projecting from an operatively lower end of the support structure;

a displaceable support member including a second pair of feet at or adjacent an operatively lower end thereof, such that a line drawn between the feet of the first pair is transverse to a line drawn between the feet of the second pair, the displaceable support member defining a central guide passage lined with a cylindrical bushing which slidingly engages the elongated guide pin such that the displaceable support member is slidably displaceable in use along a rectilinear guided path which is transverse to the lines respectively drawn between both said pairs of feet, and such that the displaceable support member is frictionally engageable with the guide pin in response to pivoting of the displaceable support member about a pivot axis which is transverse to the displaceable support member's guided path, to anchor the displaceable support member frictionally against sliding displacement relative to the guide formation; and at least one urging member for urging the displaceable support member away from the support structure along the elongated guide pin such that the first and second pairs of feet substantially bear against a support surface in use to form a stable table support arrangement.

2. The table support arrangement as claimed in claim 1, wherein the feet of the second pair are equally spaced from a longitudinal axis of the guide pin.

3. The table support arrangement as claimed in claim 2, wherein the feet of the first pair are spaced the same distance from a longitudinal axis of the support structure as the feet of the second pair are spaced from the longitudinal axis of the guide pin.

4. The table support arrangement as claimed in claim 1, wherein the line between the first pair and the line between the second pair are at right angles to one another.

5. The table support arrangement as claimed in claim 4, wherein the table support structure comprises an elongated operatively upright post and a spider connected to an operatively lower end of the post, the spider comprising four radially extending spokes which are spaced apart in a circumferentially extending series, each spoke being channel-shaped and opening operatively downwardly.

6. The table support arrangement as claimed in claim 5, wherein a first pair of aligned spokes each has a foot at its end.

7. The table support arrangement as claimed in claim 6, wherein the displaceable support member comprises an arm which is received in the other pair of aligned spokes, extending lengthwise therealong, the arm having a foot at each end.

8. The table support arrangement as claimed in claim 1, wherein the support member has a pair of axially spaced apart cylindrical bushings lining a part of a cylindrical wall of the guiding passage.

9. The table support arrangement as claimed in claim 1, wherein said at least one urging member comprises a pair of stressed springs under compression acting between the displaceable support member and the support structure, the springs being equally spaced on opposite sides of the guide formation.

10. A self stabilizing arrangement for a table, comprising:

a first support component having at each end a foot projecting in the same direction;

a guide pin fast with the first support component, the guide pin being centrally positioned with respect to the first support component and projecting in the same direction as the feet of the first support component, a second support component slidably mounted on the pin and having a foot at each end thereof projecting in the same direction as the feet of the first support component, the second support component having a centrally located mating guiding passage being slideably mounted on the guide pin by means of a cylindrical bushing in the guide passage such that the second support component is slideable in use along the guide pin toward or away from the first support component; and at least one urging member for urging the second support component away from the first support component along the elongated guide pin such that the feet of the first and second support components substantially bear against a support surface in use to form a self stabilizing arrangement for a table.

11. The self stabilizing arrangement as claimed in claim 10, in wherein the first support component and the second support component are orthogonal to one another.

12. The self stabilizing arrangement as claimed in claim 10, further comprising a locating arrangement for keeping the components in a predetermined relative configuration.

13. The self stabilizing arrangement as claimed in claim 12, wherein the locating arrangement includes a pair of aligned spokes which are fast with the first support component and project therefrom, the spokes being channel shaped to define a locating channel, with the second support component being located therein.

14. The self stabilizing arrangement as claimed in claim 10, wherein the guide pin and the guiding passage are shaped and dimensioned such that there is limited clearance between the guide pin and a wall of the guiding passage, so that there is automatic frictional locking of the second support component on the guide pin when a net moment about the guide pin is exerted on the second support component.

15. The self stabilizing arrangement as claimed in claim 10, wherein said at least one urging member comprises a pair of stressed springs under compression acting between the first support component and the second support component, the springs being equally spaced on opposite sides of the guide pin.

16. A table which includes a table support arrangement as claimed in claim 1 and a table top mounted on the table support structure thereof.

17. A table which includes a self stabilizing arrangement as claimed in claim 10 and a table top fast with the first support component thereof.

* * * * *